US005555566A

United States Patent [19]

Kuhn

[11] Patent Number: 5,555,566

[45] Date of Patent: Sep. 17, 1996

[54] METHOD OF ENHANCING POSTURE USING GARMENT POCKET STRUCTURE

[76] Inventor: Louis Kuhn, 136 Sutton Pl. South, Lawrence, N.Y. 11559

[21] Appl. No.: 397,383

[22] Filed: Mar. 2, 1995

[51] Int. Cl.[6] ..... A41D 27/20

[52] U.S. Cl. ..... 2/247; 2/108; 2/227

[58] Field of Search ..... 2/247, 253, 254, 2/108, 227

[56] References Cited

U.S. PATENT DOCUMENTS

| | | | |
|---|---|---|---|
| 198,287 | 12/1877 | Flood . | |
| 738,168 | 9/1903 | Delavoye | 2/253 |
| 1,027,904 | 5/1912 | Rogers | 2/247 X |
| 1,725,306 | 8/1929 | Rothman | 2/253 |
| 1,926,866 | 9/1933 | Doniger | 2/253 |
| 2,042,282 | 5/1936 | Tworoger | 2/247 |
| 2,323,390 | 7/1943 | Friedman . | |
| 2,997,719 | 8/1961 | Levi . | |
| 3,077,604 | 2/1963 | Colangelo . | |
| 3,217,335 | 11/1965 | Bell . | |
| 3,772,708 | 11/1973 | Segelin . | |
| 4,791,681 | 12/1988 | Dean . | |

*Primary Examiner*—C. D. Crowder
*Assistant Examiner*—Shirra L. Jenkins
*Attorney, Agent, or Firm*—Hoffmann & Baron

[57] ABSTRACT

A method of enhancing posture by using a garment having an improved pocket structure which includes a restraining pocket configured such that, upon placing ones hands into the restraining pockets, the posture of the person wearing the garment is enhanced providing improved appearance. The positioning of the restraining pocket on the garment, as well as the designed pocket depth tend to improve posture by naturally forcing the shoulders back and pulling the stomach in.

3 Claims, 5 Drawing Sheets

METHOD OF ENHANCING POSTURE USING GARMENT POCKET STRUCTURE

BACKGROUND OF THE INVENTION

1. Field of Invention

The present invention relates to garments, and more particularly relates to a garment which is adapted to improve the posture of a person wearing the garment when their hands are placed inside the pockets of the garment.

2. The Description of the Prior Art

Garments having pockets adapted to receive articles including personal objects and the hands of the person wearing the garment are well known in the art. However, when a person is standing and places his hands into the pockets of a garment in order to provide comfort such as for relaxation or warmth, the hands tend to come to rest at the bottom of the pockets. Pockets of prior art garments were generally designed to have a certain depth in order to accommodate objects placed inside the pockets as well as to retain these objects during daily activities. This pocket depth, while suitable for holding objects, tends to be relatively deep resulting in poor, unhealthy posture as the hands come to rest at the bottom of the pockets. With the hands at rest at the bottom of the pocket, the shoulders tend to roll forward and the back tends to bend producing a slouching position which creates a sloppy, unprofessional appearance.

Garments which modify the wearer's body using specially designed pockets are disclosed in the prior art. U.S. Pat. No. 3,217,335 to Bell discloses such a garment with a combined pocket and waist suppressor. The pockets include a zipper which is placed on the side seams of the garment and, when the zipper is moved into the closed position, the circumference of the garment is reduced producing a tight fit around the waist of the person wearing the garment. When the zipper is open, the garment's pocket openings are exposed.

However, this garment design includes a deep pocket which does not prevent the wearer from slouching, i.e., rolling their shoulder's forward when the hands are placed into the bottom of the pockets. Therefore, no posture enhancing benefit is achieved.

Garments having a smaller pocket located inside a larger pocket are also well known in the art. For example, U.S. Pat. No. 2,997,719 to Levi discloses placing a pocket within a pocket wherein the inside pocket includes a closure means to secure contents within the pocket. Access to the inner pocket is obtained by removing the pocket from the main pocket and moving a zipper to the open position. A disadvantage of the inner pocket disclosed in the Levi patent is that it is not sufficiently sized for the wearer to place their hands within the inner pocket. The inner pocket is merely a security pocket for small objects. Furthermore, when the wearer places his hands into the deep main pockets, the hands tend to rest at the bottom of the pocket making it difficult for the wearer to keep their shoulders back and maintain good posture.

Accordingly, there is a need for posture improving garments and especially garments having pockets which are specially designed to improve the posture of the person wearing the garment simply by placing their hands in the pockets. The present invention overcomes the disadvantages of the prior art garments and provides such a posture enhancing garment.

OBJECTS AND SUMMARY OF THE INVENTION

It is an object of the present invention to provide a garment which enhances the posture of a person wearing the garment. The garment includes a pair of pockets positioned on the garment so that when the wearer places his hands in the pockets, the wearer's hands are restrained and his shoulders are naturally forced back providing for a good, upright posture.

It is another object of the invention to provide a garment with an improved restraining pocket or posture enhancing pocket within a main pocket arrangement such that when a wearer's hands are placed into the restraining pockets, the wearer's posture is improved by naturally forcing shoulders back and pulling the stomach in.

In accordance with one form of the present invention, the garment includes a pair of pockets strategically positioned so that, upon placing one's hands into the pockets, posture may be improved by naturally forcing the shoulders back and pulling the stomach in providing for a good, upright position. Each pocket is strategically sized and positioned on the front panel of the garment. The depth of these restraining pockets is generally less than that of standard pockets. Due to the location and depth of the pockets when a wearer's hands are placed in them, the wearer's posture is naturally improved.

In addition to having a shallow depth pocket on each front panel, the garment may include a dual pocket arrangement on each panel. The dual pocket arrangement is preferably a pocket-in-a-pocket including a main pocket which is sufficiently sized holding and retaining objects and a restraining pocket positioned within the main pocket. The restraining pocket is more shallow in depth than the-main pocket and thereby restricts the movement of the wearer's hand. Furthermore, the pockets are strategically placed on the front panel of the garment so that when the wearer's hands are placed in the restraining pockets, posture is naturally improved. For example, with respect to an outer garment such as a jacket, the restraining pockets are preferably patch pockets having openings generally formed at an angle with respect to the side seams of the garment. The angle of the pocket opening is designed to allow easy entrance of the wearer's hands, yet the pocket is designed to restrain the wearer's hands.

In a dual pocket arrangement, the main pockets may also be in the form of slash-type pockets. Slash-type pockets can be defined as a class of pockets in which the panels forming the pockets are positioned beneath the outer material of the garment. Furthermore, the pocket openings of the slash pockets are generally formed in a front panel of the garment and incline downwardly away from a center line of the garment. The slash pocket opening is preferably angled to correspond to an angle of the wearer's hand which is naturally formed when the wearer bends his arm at the elbow to place his hands into the side pocket.

In the dual pocket arrangement, the restraining pocket is preferably in the form of a patch pocket positioned within the main slash pocket. Alternatively, a dual pocket arrangement formed in accordance with the present invention may be in the form of two patch pockets whereby both the main pocket and restraining pocket are patch-type pockets formed on the garment. A patch pocket can be defined as a pocket in the form of a patch which is attached directly to an outer surface of the garment.

It is also envisioned that the pocket arrangement, including a main pocket and restraining pocket, may also be adapted for use in trousers, skirts or any other garment in which pockets are appropriate. Thus, by proper placement of the pockets and dimensioning the restraining pocket properly, the advantages described above with respect to an outer garment, such as a jacket, may be applied to a trouser.

The pocket arrangement including a main pocket and a restraining pocket may be formed from either three or four fabric panels. More specifically, in a three-panel arrangement, two panels are sewn together to form a main pocket. The third panel is sewn to either one of the two panels forming the main pocket as a patch pocket to form the restraining pocket. The opening of the main pocket and the restraining pocket substantially correspond to each other. The panel forming the restraining pocket is generally smaller in size than the panels forming the main pocket to thereby achieve the desired results of the present invention. Alternatively, in a four-panel arrangement, both the restraining pocket and the main pocket are formed from two panels. The restraining pocket is positioned within the main pocket so that the opening for the main pocket also provides an entrance to the restraining pocket.

The present invention is also directed to a method for enhancing posture. The method includes the steps of wearing a garment having the posture improving pockets of the present invention and placing the hands of the person wearing the garment into the restraining pockets to thereby naturally force the shoulders to a backward position and pull the stomach in, producing an improved posture and appearance.

A preferred form of the garment, as well as other embodiments, objects, features and advantages of this invention, will be apparent from the following detailed description of illustrative embodiments thereof, which is to be read in connection with the accompanying drawings.

DETAILED DESCRIPTION OF THE PREFERRED EMBODIMENT

Generally, garments such as jackets, trousers and skirts include at least one pocket for holding articles or which are adapted for receiving the hands of the person wearing the garments.

Many garments contain pockets which provide only one area in which to place ones hands and small objects. Accordingly, these pockets were designed having a certain depth to perform several functions including holding small objects and retaining them during daily activities, as well as providing a place for the wearer's hands. If the pockets are too shallow, objects tend to fall out when the wearer sits down or when the wearer engages in physical activity such as running or jumping. Therefore, the depth of these multi-functional pockets were generally such that when a wearer placed his hands into the bottom of these deep pockets, his posture tended to slouch due to the shoulders naturally rolling forward. Therefore, the goal of keeping ones shoulders back and stomach in to maintain correct posture was difficult.

The present invention addresses the problem of poor posture when hands are placed in garment pockets. The present invention includes a specially designed posture enhancing pocket or restraining pocket which is strategically positioned on the garment. In one embodiment, the restraining pocket is situated within a main pocket. While it is known in the prior art to form a pocket inside a pocket, the inner pockets have generally been adapted for holding small objects securely in the pocket, but have not been designed to accommodate the wearer's hands. Furthermore, the pockets of the present invention are strategically located on the garment to provide for enhanced posture when the wearer places his hands in the restraining pockets. Finally, the pockets of the present invention are the correct depth to prevent or restrain the hand from being placed too far forward in the garment to thereby achieve the posture improving result of the present invention.

Figure 1A:
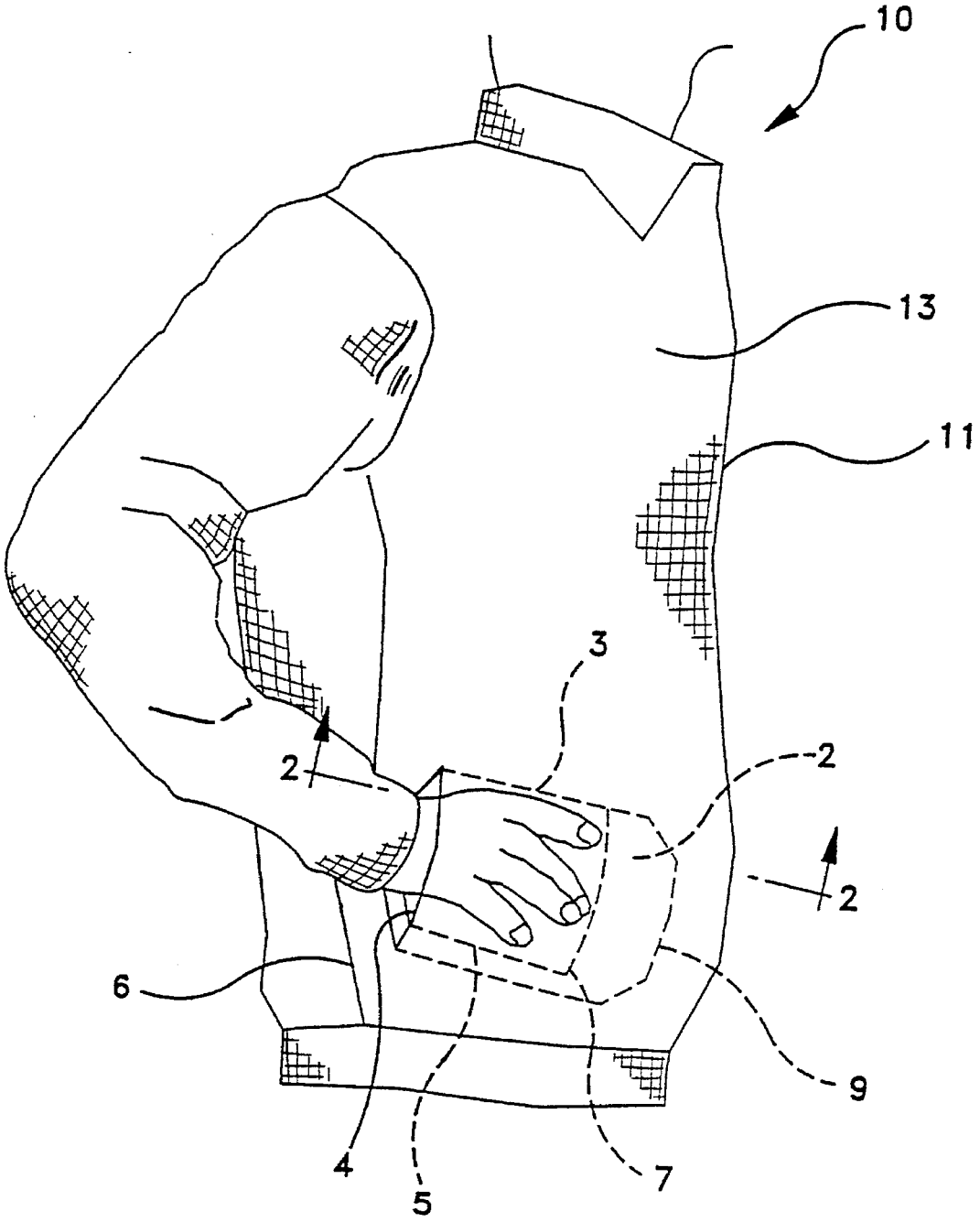
FIG. 1*a* is a front elevational view of a jacket illustrating pockets formed in accordance with the present invention shown in phantom.

Referring to FIG. 1*a*, a posture enhancing garment 10 of the present invention includes a main pocket 2 provided to hold objects and having a depth substantially similar to that of standard pockets. The garment 10 also includes a restraining pocket 4 positioned within the main pocket 2. The restraining pocket 4 is designed to have a depth more shallow than the main pocket 2 and thereby limit the travel of the hands when placed in the restraining pockets 4. By limiting or restraining the travel of the hand into the pocket, the wearer's shoulders can be naturally forced to remain back and not roll forward and the stomach be pulled in. In this manner, the back of the person remains substantially straight providing for good posture and a neat, professional appearance.

As illustrated in FIG. 1*a*, a preferred embodiment of the posture improving garment is in the form of a jacket 10 having two front panel portions 13 each extending from a side seam 6 to a front edge coinciding with a center line of the jacket 11. The jacket 10 includes a pair of main pockets 2, with each pocket positioned on a front panel of the jacket so that the openings of the main pockets are formed in the front panel of the garment and incline downwardly away from the centerline of the garment. The opening is preferably angled to correspond to an angle of the wearer's hand which is naturally formed when the wearer bends his arm at the elbow to place his hand into the side pocket. Both the main pocket 2 and the restraining pocket 4 are sufficiently sized for receiving the hands of the person wearing the garment. However, the main pocket 2 does not provide the posture enhancement afforded by the restraining pocket 4 since it is relatively deep and designed for holding objects therein. Accordingly, to practice the present invention, the main pockets 2 are preferably used for holding objects leaving the restraining pockets 4 free for accommodating the wearer's hands.

Figure 2:
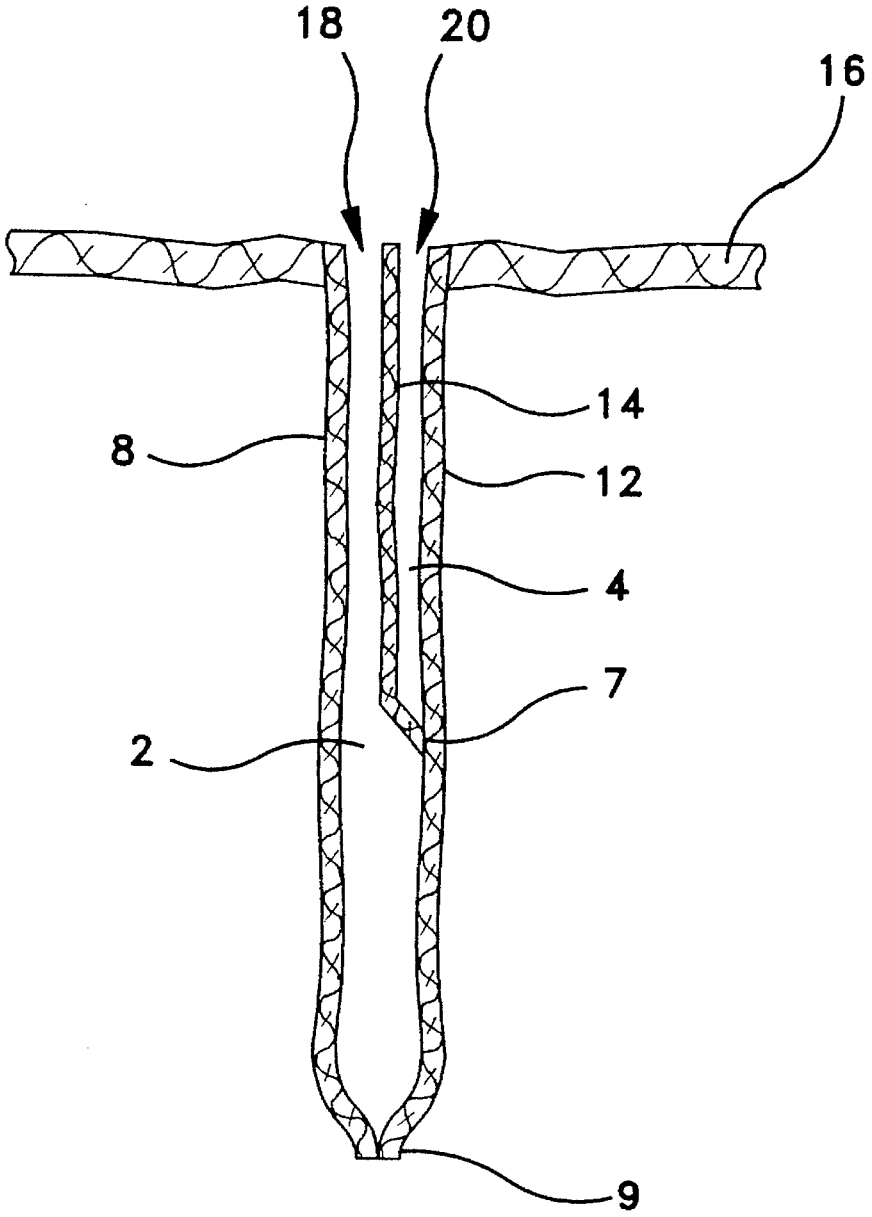
FIG. 2 is a cross-sectional view of the pocket arrangement illustrated in FIG. 1 taken along lines 2—2.

The main pockets illustrated in FIG. 1*a* are slash-type pockets. Slash-type pockets are formed from panels which are positioned beneath the outer material of the garment. The main pockets and restraining pockets are generally constructed from a total of either three or four fabric panels depending upon whether the restraining pocket is made from two separate panels or one panel and a panel from the main pocket in a patch pocket form. The arrangement of a main pocket and a restraining pocket being formed from three panels is illustrated in FIG. 2. A first panel 8 and a second 12 panel, which are substantially rectangular in shape and similar in size, are sewn along three edges forming the main pocket 2. The opening of the main pocket is secured to a front panel of the jacket material 16. A third panel 14, smaller in size than the first 8 and second 12 panels, is sewn to the either the first or second panel along three edges of the third panel forming a restraining pocket 4.

As shown in FIG. 1*a*, the restraining pocket 4 is bound by a top seam 3, a bottom seam 5, and a back seam 7. The back seam 7 of the restraining pocket is located closer to the pocket opening than the back seam 9 of the main pocket 2. In a preferred embodiment, the center of the restraining pocket opening is located on a front panel of a jacket approximately one-third to approximately two-thirds of a distance defined by the wearer's underarm and the wearer's waist line, (i.e., approximately eight to ten inches below the underarm for the average male) and approximately two to approximately six inches forward of the side seam. The restraining pocket back seam 7 defining the pocket depth is preferably located approximately six to approximately ten inches from a corresponding side seam of the garment. The depth of the restraining pocket measured from the back seam 7 to the pocket opening is approximately two inches to approximately six inches. The top seam 3 may correspond with a top seam of the main pocket. Accordingly, the third panel forms the restraining pocket 4 having a restricted depth less than that of the main pocket 2 and having an opening sufficiently sized for accommodating a hand which substantially corresponds to the opening of the main pocket.

The pocket location is imperative to practicing the present invention. The strategic placing of the pockets provides a garment in which posture can be enhanced when ones hands are placed in the restraining pockets. More specifically, when the wearer places his hands into the restraining pockets, his shoulders are naturally forced back and the stomach is pulled in providing for improved posture. Deep pockets which allow hand travel to extend more forward or downward will not provide the posture enhancing effect of the present invention.

Figure 1B:
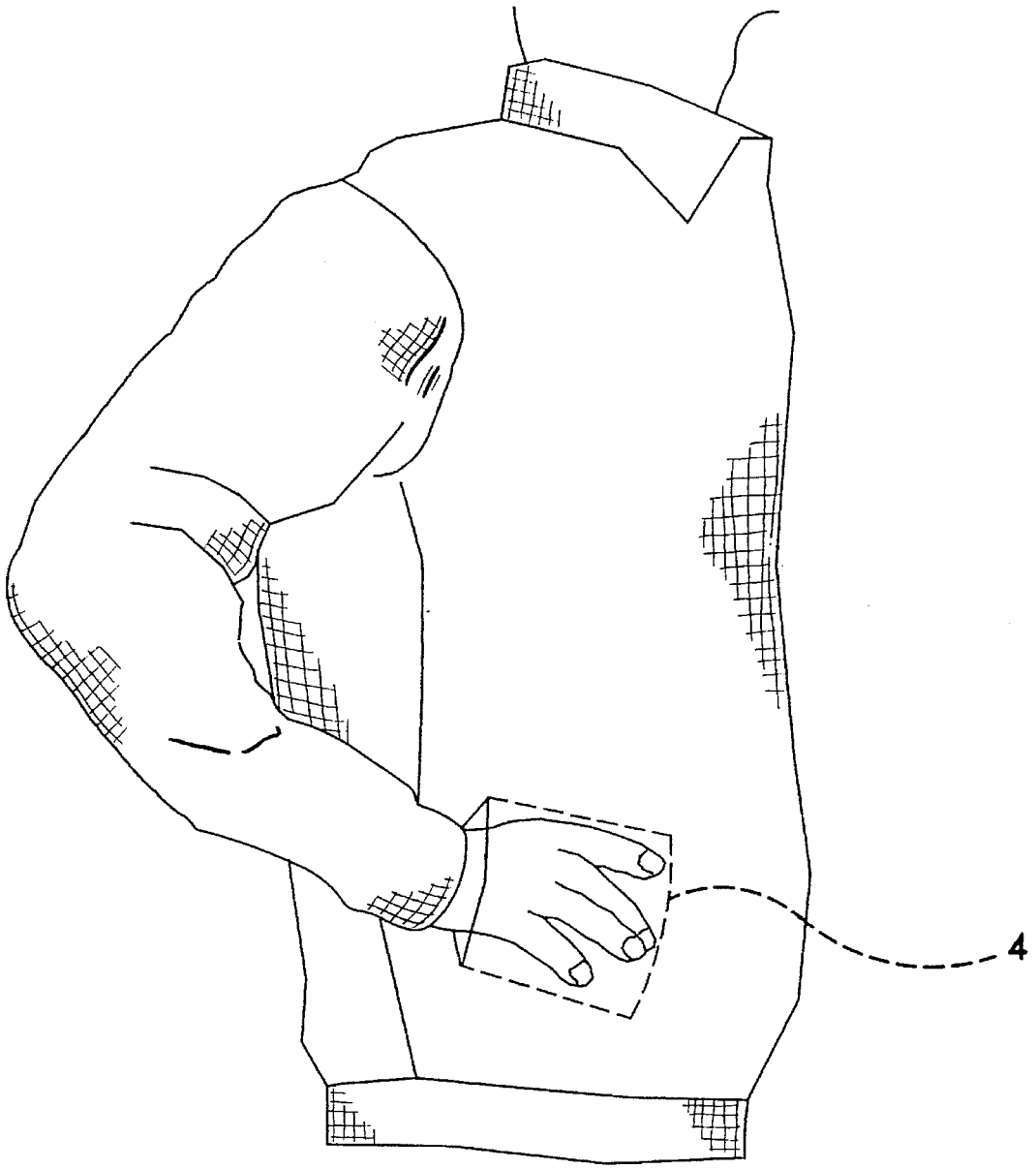
FIG. 1*b* is a front elevational view of a jacket illustrating restraining pockets formed in accordance with the present invention shown in phantom.

It is also envisioned that the present invention can be achieved using a single strategically placed and sized restraining pocket 4 on each side of a garment as illustrated in FIG. 1*b*. The restraining pocket can be either a slash pocket or a patch pocket having an opening sufficiently sized to accommodate a hand, yet, the pocket is dimensioned to achieve the results of the present invention to restrain the hands within the pockets from being permitted to be placed too far forward on the garment. The advantages of the posture enhancing pockets will become more readily apparent to those of ordinary skill in the art by the detailed description herein.

FIG. 2 is a cross-sectional view of a dual pocket arrangement formed in accordance with the present invention. The cross-sectional is taken along line 2—2 as shown in FIG. 1*a*. The opening to each of the pockets is divided into two separate openings. More specifically, the pocket includes a first opening 18 leading to the main pocket 2 and a second opening 20 leading to the shallower, restraining pocket. Also illustrated are the two panels 8, 12 forming the main pocket 2 and the third panel 14 forming the restraining pocket 4. When the hands of a person wearing a garment formed in accordance with the present invention are inserted into the restraining pockets 4, the hands comes to rest at the bottom of the restraining pockets. However, due to the strategic positioning of the restraining pockets and the shallow depth of the restraining pockets, the wearer's shoulder's tend to be naturally pushed back and the stomach pulled in thereby providing an improved upright posture without slouching.

Figure 3A:
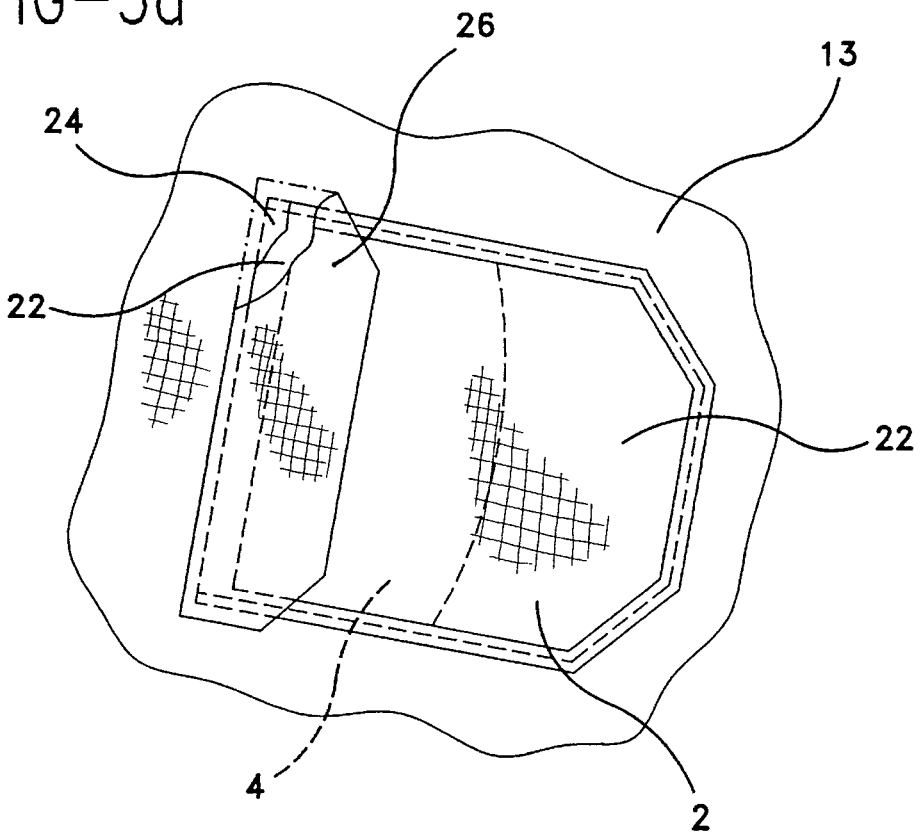
FIG. 3*a* is a partial view of a garment illustrating a patch pocket formed in accordance with the present invention with the restraining pocket shown in phantom.

FIG. 3*a* illustrates an alternative preferred embodiment in which the pocket of the present invention is formed as a patch pocket. In a patch pocket design, the panels comprising the pocket are external to the garment rather than lying beneath the outer garment material. The patch pocket illustrated in FIG. 3*a* is positioned on the garment's front panel 13 as described with respect to the slash pocket. More specifically, the opening is strategically positioned similarly to that of the previously described slash-type pockets. The patch pocket includes an outer panel 22 sewn around three edges to a top surface of the garment material thereby forming a main pocket 2. A second fabric panel 24, shorter in length than the first outer panel 22, is either sewn to the outer garment material within the main pocket 2 or, in the alternative, may be sewn on top of the main pocket 2 to form the posture enhancing pocket or restraining pocket 4. As previously described, the restraining pocket has a depth less than that of the main pocket and an opening which substantially corresponds to the opening of the main pocket. Alternatively, the opening for the restraining pocket 4 may be smaller than the opening for the main pocket 2 provided that the restraining pocket is sufficiently sized for receiving a hand of the person wearing the garment. As also illustrated in FIG. 3*a*, the pocket, whether a slash pocket or a patch pocket, may include a pocket flap 26 to cover over the opening of both the main pocket 2 and restraining pocket 4. If the garment includes a pocket flap 26, the flap may either be left out to cover the pocket openings or, in the alternative, the flap may be tucked into the pocket opening to provide a different appearance to the garment.

Figure 3B:
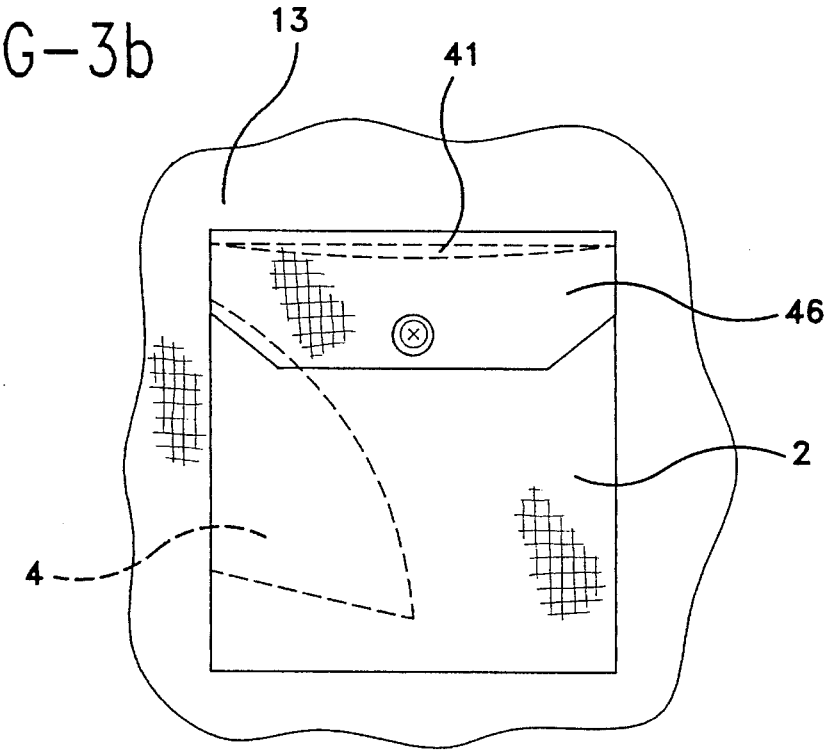
FIG. 3*b* is a partial view of a garment illustrating an alternative patch pocket arrangement formed in accordance with the present invention with the restraining pocket shown in phantom.

The patch pocket arrangement may alternatively be designed such that the openings for the main pocket and restraining pocket are positioned along adjacent sides of the patch pocket arrangement as illustrated in FIG. 3*b*. More specifically, the main pocket opening 41 may be a top opening pocket whereas the restraining pocket 4 is a side opening pocket. The main pocket 2 may be formed by a pair of panels stitched together to form a pocket opening 41 at a top portion thereof. The main pocket 2 is attached to the outer garment material leaving an opening along a side seam for providing access to an opening of a restraining pocket 4 positioned under the main pocket in the form of a patch pocket. As also illustrated in FIG. 3*b*, the pocket may include a pocket flap 46 to cover the opening of the main pocket. Both the main pocket and the restraining pocket may include bellows on the bottom and/or sides of the pocket to allow expansion of the pocket. The bellows are generally formed of material folded along the sides and/or bottom of the pocket. When empty, the pocket tends to lie flat. However, when objects are placed into the pocket, the bellows allow the pocket to expand.

Figure 4:
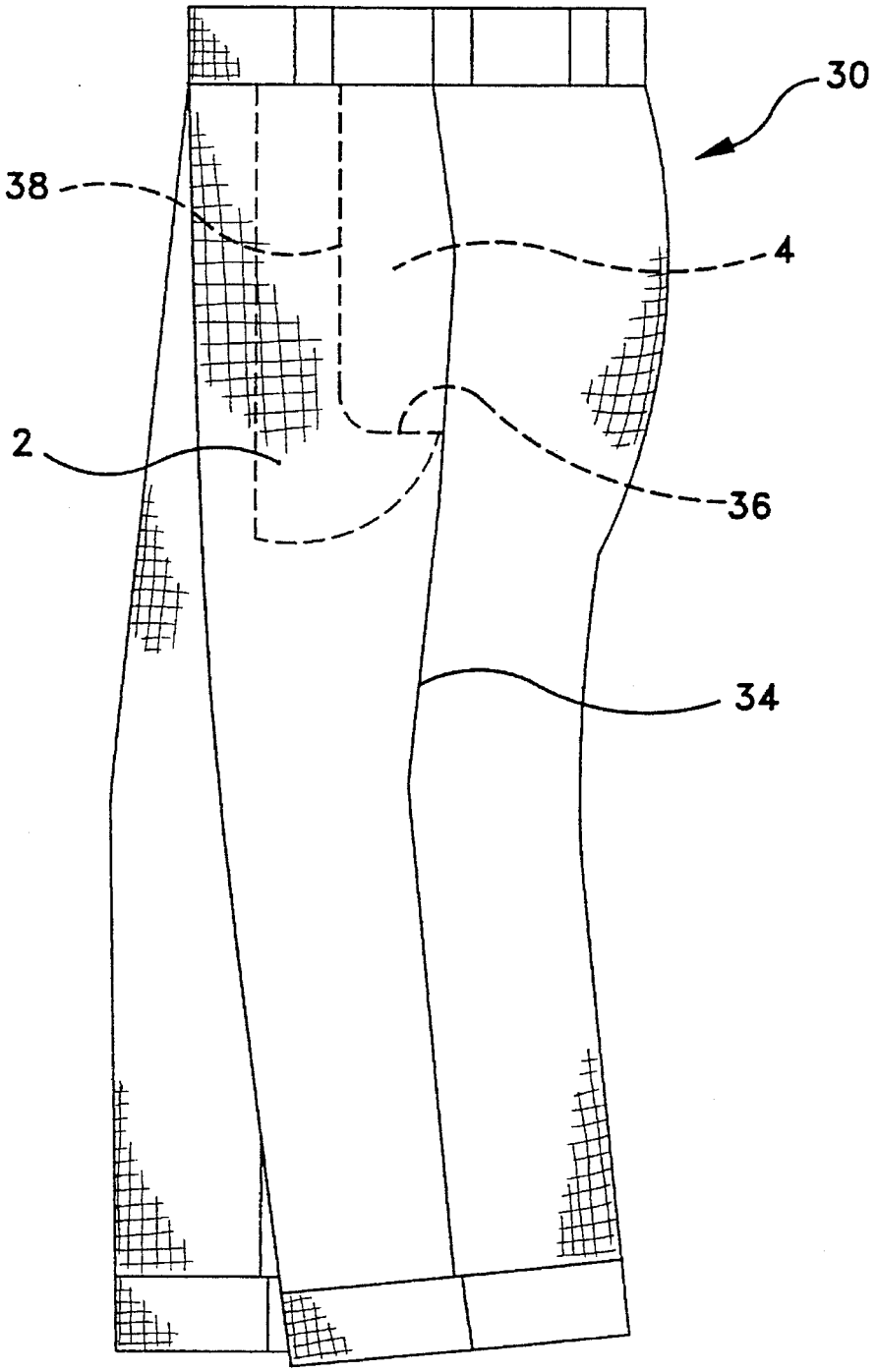
FIG. 4 is a front elevational view of a trouser illustrating pockets formed in accordance with the present invention shown in phantom.

FIG. 4 illustrates yet another preferred embodiment of the present invention in which the posture improving garment having the novel pocket structure is a trouser 30. In the trouser 30, the novel pocket structure is located such that the pocket opening substantially corresponds with an outside seam 34 of the trouser. The main pocket 2 may be formed from commonly known methods for making trouser pockets. As previously noted, the main pocket 2 is sufficiently sized for holding objects and is sufficiently deep so that objects placed in the pockets, such as coins, will not fall out of the pocket when the person is sitting.

With respect to the main pocket, the top of the pocket opening is preferably located just beneath the waistband and continues downward substantially parallel to the outside seam 34. Similar to the previous embodiments, the main pocket 2 and restraining pockets 4 may be made from three fabric panels. More specifically, a bottom seam 36 of the restraining pocket is preferably located not more than six inches below the top of the trouser waistband with the seam running from the outside seam 34 towards the front of the trousers. The bottom seam 36 provides support for the hand and limits travel of the hand from being too deeply placed in the pocket. A front seam 38 of the restraining pocket preferably runs from the waist line down to join with the bottom seam 36 of the restraining pocket. The front seam 38 is preferably from about two to about five inches deep when measured from the pocket opening. The restraining pocket of the trouser, bounded by the bottom seam 36 and front seam 38 thereof, restrains the hands in a desired position to improve posture by naturally forcing the wearer's shoulders back and pulling the stomach in when the wearer's hands are placed in the pockets.

Similar to the design of pockets of the present invention for a jacket, the restraining pocket 4 for the trouser is sewn along three edges and has an opening substantially corresponding to the opening for the main pocket 2. As described above, the restraining pocket 4 is preferably more shallow than the main pocket in overall depth and is also smaller along a front edge 38 to restrict a hand being placed in the restraining pocket from being permitted to go too far forward into the trouser permitting the persons shoulders to roll forward and create a slouching appearance. Thus, by restraining the depth and front edge of the pocket, the desired enhanced posture can be achieved whereby placing ones hands in the restraining pockets keeps the shoulders back and stomach pulled in to create an improved posture and appearance.

As will be appreciated by those of ordinary skill in the art of garment making, the novel pocket structure and strategically located position of the pockets can be adapted for use on a variety of different garments. Although the present invention has been described in detail for adaption to a jacket or trouser, it is envisioned that the present invention can also be adapted to be used in skirts, sweatshirts, or any other garment for which pockets are appropriate. Furthermore, although specific embodiments describing the location of the pockets have been defined herein, it will be appreciated by those of ordinary skill in the art that the pocket locations may be different for childrens' clothes, womens' clothes and mens' clothes, yet still achieve the posture enhancing improvement of the present invention. The present invention relies on the strategic positioning of the restraining pocket having dimensions defined herein in order to naturally force the shoulders back and pull the stomach in when the wearer places his hands into the restraining pockets.

Although one preferred embodiment includes a main pocket for holding articles and a restraining pocket for providing posture enhancement, it will be appreciated by those of ordinary skill in the art that the main pocket may be eliminated and a garment produced for enhancing posture which includes only the strategically positioned restraining pockets as illustrated in FIG. *b*. It will also be appreciated by those of ordinary skill in the art that the restraining pockets can be placed on the garment independent of the main pocket and may be independently constructed. Lastly, those of ordinary skill in the art will appreciate that the panels used to form the restraining pockets and the main pockets may have any geometry and be comprised of any material used to make garments.

The present invention is also directed to a method for enhancing posture. The method includes the steps of wearing a garment having the posture improving pockets of the present invention and placing the hands of the person wearing the garment into the restraining pocket to thereby force the shoulders back and pull the stomach in, producing an improved posture. More specifically, the garment for use in the method described above includes a main pocket for holding objects and a restraining pocket for the hands of the garment wearer. The restraining pocket is specifically designed in accordance with the present invention as described above so that when one places his hands in the restraining pockets, the person's shoulders will not roll forward, but rather remain pushed back producing a desired posture and improved appearance.

Although the illustrative embodiments of the present invention have been described herein with references to the accompanying drawings, it is to be understood the invention is not limited to those precise embodiments, and that various other changes and modifications may be effected therein by one skilled in the art without departing from the scope of the invention.

What is claimed is:

1. A method of enhancing posture, comprising the steps of:

providing a garment including a pair of exterior front panel portions each extending from a side seam to a front edge coinciding with a center line of the garment;

strategically placing a restraining pocket on each front panel portion of the garment;

providing an opening for each of the restraining pockets such that the wearer of the garment can comfortably place their hand into the opening;

providing each restraining pocket with a shallow depth defined by a back seam opposite the pocket opening, the shallow depth of the pocket being less than that of a standard pocket such that the back seam restricts the movement of the wearer's hand;

placing the hands of the wearer inside the restraining pockets such that the hands are restrained to thereby force the wearer's shoulders back resulting in an improved posture and appearance.

2. The method of enhancing posture of claim 1, wherein the garment is a pair of trousers.

3. The method of enhancing posture of claim 1, wherein the garment is a jacket.

* * * * *